United States Patent [19]

Paquin

[11] 4,201,186

[45] May 6, 1980

[54] SOLID-FUEL BURNER

[76] Inventor: Patrick J. Paquin, 765 Paradise Ave., Hamden, Conn. 06514

[21] Appl. No.: 887,749

[22] Filed: Mar. 17, 1978

[51] Int. Cl.[2] ..... F24C 15/28; F24B 13/04

[52] U.S. Cl. ..... 126/83; 110/267; 110/322; 110/327; 126/69; 126/74; 126/75; 126/285 A

[58] Field of Search ..... 126/74, 75, 79, 69, 126/68, 83, 299 F, 285 A; 110/267, 270, 322, 327

[56] References Cited

U.S. PATENT DOCUMENTS

| | | | |
|---|---|---|---|
| 1,086,366 | 2/1914 | Hirt | 110/235 |
| 1,866,427 | 7/1932 | Siemer | 126/83 |
| 2,104,127 | 1/1938 | Hickman | 126/83 |
| 2,374,808 | 5/1945 | Edwards | 110/29 |
| 2,419,379 | 4/1947 | Tindell | 126/73 |
| 2,481,164 | 9/1949 | Sherman et al. | 126/73 |
| 2,530,522 | 11/1950 | Harris | 110/29 |
| 2,543,289 | 2/1951 | Howes et al. | 126/73 |
| 2,855,919 | 10/1958 | Prim | 126/83 |

OTHER PUBLICATIONS

Barden, "A Wood Stove Buyers Guide", 1977, Poster; copies from Northeast Cary, Hallowell, ME.

*Primary Examiner*—James C. Yeung
*Assistant Examiner*—Daniel J. O'Connor
*Attorney, Agent, or Firm*—St. Onge, Steward, Johnston, Reens & Noë

[57] ABSTRACT

A stove or furnace in which the products of combustion are recirculated inside the combustion chamber by means of a V-shaped partition or baffle, the apex of which extends downward directly above the primary fire zone, so that the combustion products rising from the fire are deflected outward and then flow downward back into the primary fire zone. Secondary air may be mixed with the unburned combustion products above the primary fire zone to form a combustible mixture which is burned on re-entering the fire zone.

11 Claims, 5 Drawing Figures

SOLID-FUEL BURNER

BACKGROUND OF THE INVENTION

The invention relates to heating apparatus which burns solid fuel, and it relates more particularly to wood burning stoves or furnaces which have means for recirculating and burning the combustible gases or volatiles liberated by the wood during the first stage of burning.

The physical and chemical transformations which take place when solid fuels are burned in a stove or furnace are well understood. Basically what takes place is that as the fuel burns it releases volatile matter during a first stage of the burning process, and then the volatiles burn during the second stage while the charcoal remaining from the first stage continues to burn. Once the fire is established, the burning charcoal and gases in the primary fire zone liberate more combustible gases and volatiles from the fuel. In many stove designs most of the charcoal, but only a small portion of the volatile matter is burned, the largest part of the unburned combustion products being lost up the chimney.

Since it is not possible to provide enough air during the first stage to burn all the combustion products liberated in a fuel bed without undesirably increasing the rate of combustion, the fire is usually controlled by regulating the amount of air supplied to the primary fire zone. It is appreciated that the efficiency of solid-fuel burners is directly proportional to the success achieved in completing the combustion of the unburned combustion products before they escape to the atmosphere, and with that in mind many prior solid-fuel burners have been designed in an attempt to obtain full combustion by introducing a secondary supply of air into the combustion chamber or flue.

One of the principal problems encountered in furnishing secondary air or in providing so-called "secondary combustion chambers" is in maintaining the combustion products at the required temperature of approximately 1200° F. for combustion, so that they will burn when the secondary air is mixed with them. For example, it does no good to mix air with unburned gases at a point remote from the flame, because as the gases move away from the primary fire zone, they cool rapidly below the temperature required for combustion. Discussions of the principles of burning solid fuels, the problems involved, and various designs for stoves, furnances and the like, may be found in a publication entitled "A Wood Stove Buyer's Guide" by Albert A. Barden, III, excerpts of which appear in an article entitled "Wood-burning Basics" in the 1977 Fall issue of *Farmstead Magazine.* Attention is also directed to U.S. Pat. Nos. to Sherman et al 2,481,164 and to Howes et al 2,543,289 for additional discussions on the subject.

Another important factor to be taken into consideration in a furnace or stove that burns solid fuel is the manner in which the fuel is fed into the fire. In the so-called magazine type of stove, the fuel is usually fed by gravity to the fire as it is consumed. Examples of such self-feeding furnaces and stoves are shown in U.S. Pat. Nos. to Hirt 1,086,366, Edwards 2,374,803, Tendell, Jr. 2,419,379 and Harris 2,530,522.

The primary object of the present invention is to provide apparatus for logs or chunks of wood, in which the volatile combustion products are recirculated back into the primary fire zone and are mixed with a supplemental or secondary supply of air, which provides the oxygen required to burn the combustion products before they escape up the chimney and at a temperature in excess of that required to support combustion without increasing the rate at which the wood itself burns. Another important object of the invention is to provide a wood burner with an exhaust chamber through which air or water ducts extend for removing heat from the exhaust gases, thereby reducing the heat-losses due to hot exhaust gases passing up the chimney without lowering the temperature of the fire in the combustion chamber.

SUMMARY OF THE INVENTION

The invention resides fundamentally in centrally dividing the upper part of the combustion chamber of a wood burner by means of a V-shaped partition or baffle located directly above the primary fire zone with the apex of the V extending downward into close proximity to the fire, such that the combustion products rising from the fire are deflected outward against both sides of the burner as they cool and then flow downward again into the primary fire zone, thereby creating turbulence on opposite sides of the V-shaped partition which continuously recirculates the combustion products back into the primary fire zone in order to burn them. Some combustion products are continually exhausted from the combustion chamber through an exhaust opening in the V-shaped baffle at or near the apex, while air is supplied adjacent the bottom of the combustion chamber so that the primary fire burns only in a zone in the center of the combustion chamber directly under the V-shaped baffle. The space within and above the V-shaped partition forms an exhaust chamber through which the burned gases travel to the stack or chimney.

The primary fire zone is formed between a pair of bottom walls of the combustion chamber which slope inwardly toward the charcoal bed so that the chunks of wood slide under gravity into the fire zone, where it is subjected to the most intense heat to produce combustible products, which rise in the central portion of the combustion chamber and are recirculated by the V-shaped baffle the charcoal which remains forming a glowing bed of coals in the center. Air for combustion of the fuel in the primary fire zone may be supplied through a conventional damper located at the level of the coal bed or below it if a grate is provided. In addition, in order to avoid variations in the burning rate of the fire due to atmospheric conditions, a forced draft can be provided by supplying air under pressure to the primary fire.

To ensure sufficient oxygen for complete combustion of the recirculated gases, a secondary supply of air is provided above the primary fire zone. Secondly, air ports may be located adjacent the outer walls of the combustion chamber near the sloping bottom walls and/or at the exhaust opening in the V-shaped baffle, so that additional air is supplied above the primary fire zone where it combines with the hot unburned combustion products but does not increase the rate at which the logs themselves burn. Since some unburned volatile matter will inevitably be drawn through the exhaust opening at the apex of the V-shaped baffle, it is desirable to supply additional air at the opening to the exhaust chamber in order to burn such combustible matter at this point before it cools below the temperature necessary for combustion. It has been found, moreover, that by providing the V-shaped baffle and concentrating the primary fire only in the center directly under the apex of the "V" in accordance with the present invention, the amount of unburned combustion products escaping from the combustion chamber is so small that little or no condensation and carbon deposits form within the exhaust chamber or in the chimney.

DETAILED DESCRIPTION OF THE PREFERRED EMBODIMENT

The advantages of the invention will become more apparent from the description hereinafter of one embodiment of the invention shown in the accompanying drawings, wherein FIG. 1 is a front elevational view of a wood burner embodying the invention, the doors being shown open and partially broken away;

Figures 1, 5:
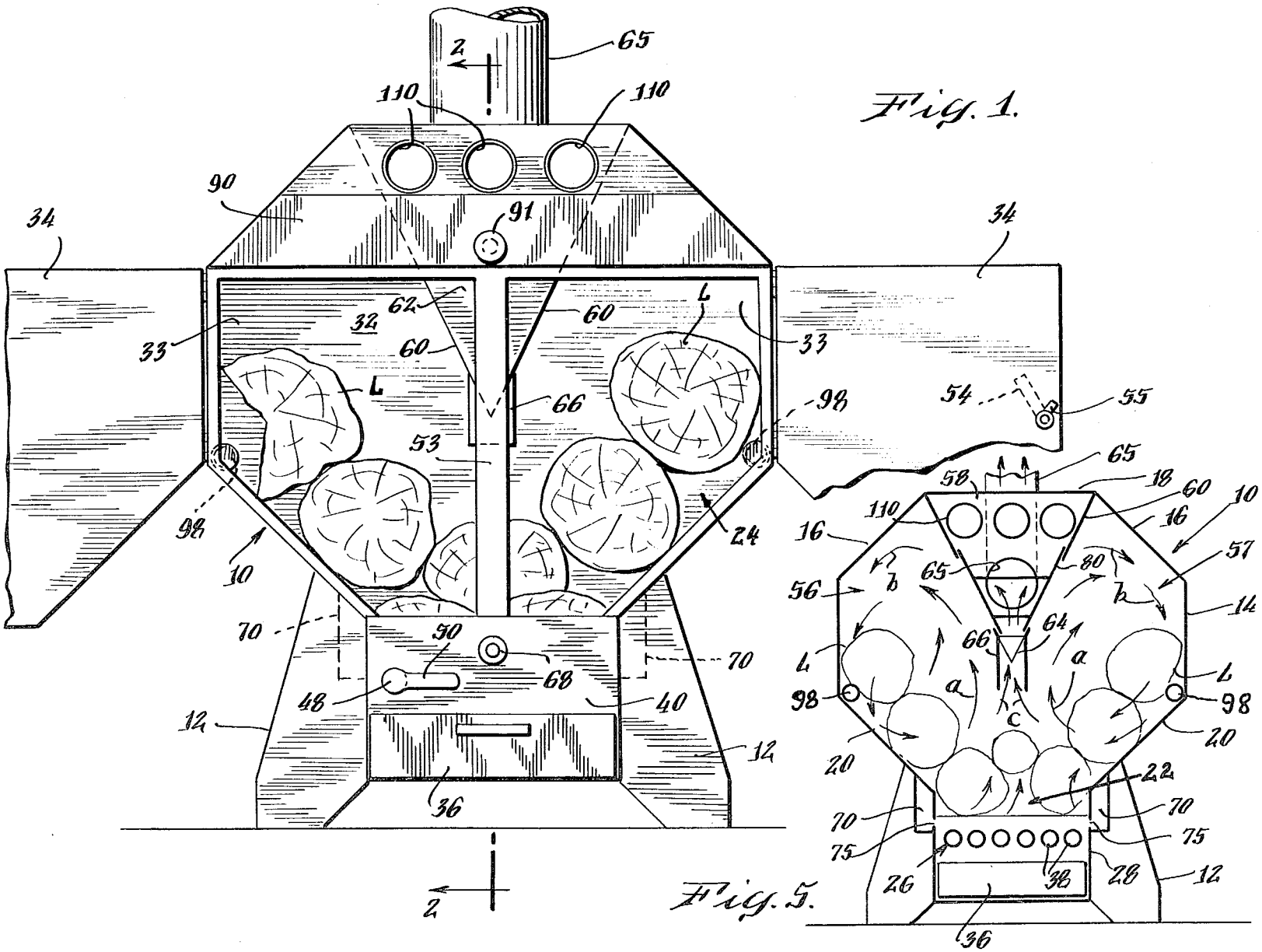
FIG. 5 is a schematic view of the burner similar to FIG. 3 but on a smaller scale, showing the flow of gases inside the combustion chamber.

The wood burner illustrated in the drawings consists of an octagonally-shaped metal casing 10 mounted on legs 12 which space it from the floor. Casing 10 has vertical outer side walls 14, 14, sloping outer upper walls 16, 16, a horizontal top panel 18 and sloping bottom walls 20, 20 which open downwardly into a central primary fire zone 22 at the bottom of the combustion chamber (designated generally at 24) which occupies most of the space within casing 10. An ash pit 25 is provided below a grate 26 on which the logs L are burned, the logs and fire bed being shown more or less diagrammatically in FIGS. 1, 3 and 5. The primary fire zone 22 and ash pit 25 are formed between a pair of vertical panels 28, 28 and between the lower portions of bottom walls 20, 20. Panels 28, 28 are welded at their upper edges to the lower edges of bottom walls 20, 20, respectively, and a horizontal bottom panel 30 is welded to the lower edges of vertical panels 28, 28. A vertical, octagonally shaped rear wall 32 closes off the back end of casing 10, the front of the casing being provided with doorways 33, 33 (FIG. 1), through which logs are loaded endwise into the burner. Doors 34, 34 are hinged to the outer sides of doorways 33, 33 for closing the burner and preventing undesired leakage of air into the combustion chamber. The walls and panels making up casing 10 are in this instance made of suitable heavy-guage sheet steel and welded throughout in order to make the casing substantially airtight.

Figure 3:
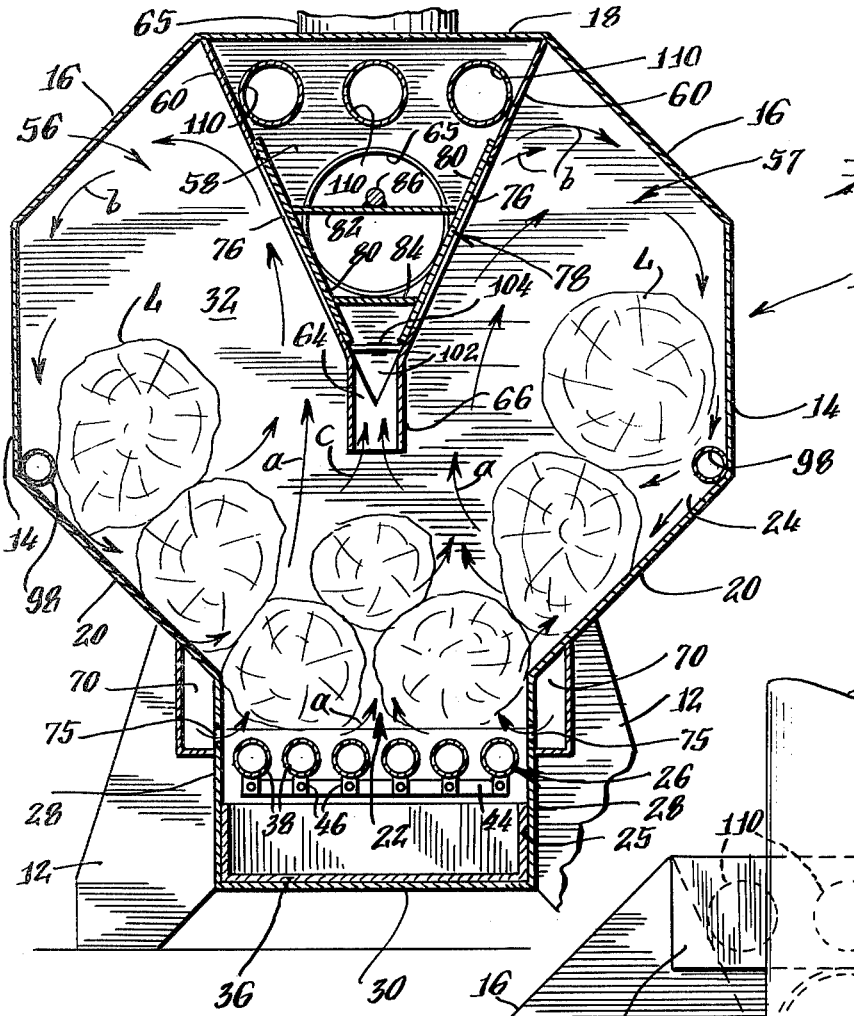
FIG. 3 is a cross-sectional view taken on the line 3—3 of FIG. 2.
Figure 4:
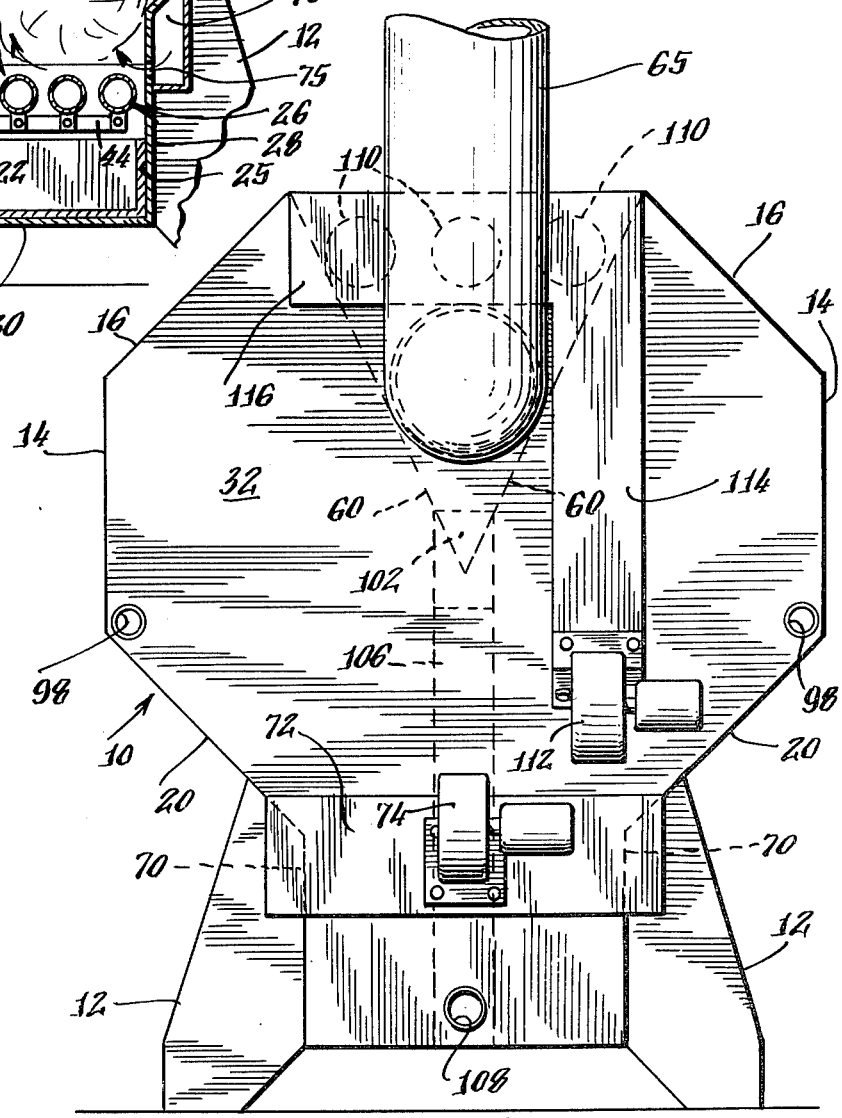
FIG. 4 is a rear elevational view.

Most of the wood is consumed in the primary burning zone 22 in the center of the combustion chamber 24. As illustrated in FIG. 3, logs L are stacked in the burner along both bottom walls 20, 20, so that as the wood burns in the primary burning zone 22 above grate 26, the logs slide down the sloping walls 20, 20 to replace those that have been consumed. In this way the logs are automatically fed into the area of the combustion chamber where most of the initial burning of the wood takes place thereby achieving self-stoking over a period of time limited only by the capacity of the casing 10.

Wood grate 26 is desirably constructed so that the ashes not only drop continuously into a removable ash pan 36, but can also be manually shaken down. To this end, grate 26 consists of a horizontal row of iron pipe lengths 38, each rotatably mounted at both ends. The front ends of pipes 38 are supported on an end panel 40 of casing 10 below doors 34, while the back ends are supported on an intermediate panel 42, spaced forward of the rear wall 32 of the casing. Pipes 38 are loosely held at each end in holes in horizontal bearing bar which rests on a shelf welded to panels 40 and 42, respectively. The grate 26 can accordingly be removed bodily from the burner for repair or replacement. Pipes 38 are also interconnected at their rear ends by a horizontal bar 44, to which is pivoted a tab 46 depending from each pipe. Since tabs 46 are individually welded to their respective pipe length 38, pivotal movement of any one of the pipes 38 results in corresponding movement of the others, thereby causing the ashes on the grate to drop between the pipes into ash pan 36, which can be readily removed and emptied.

Figure 2:
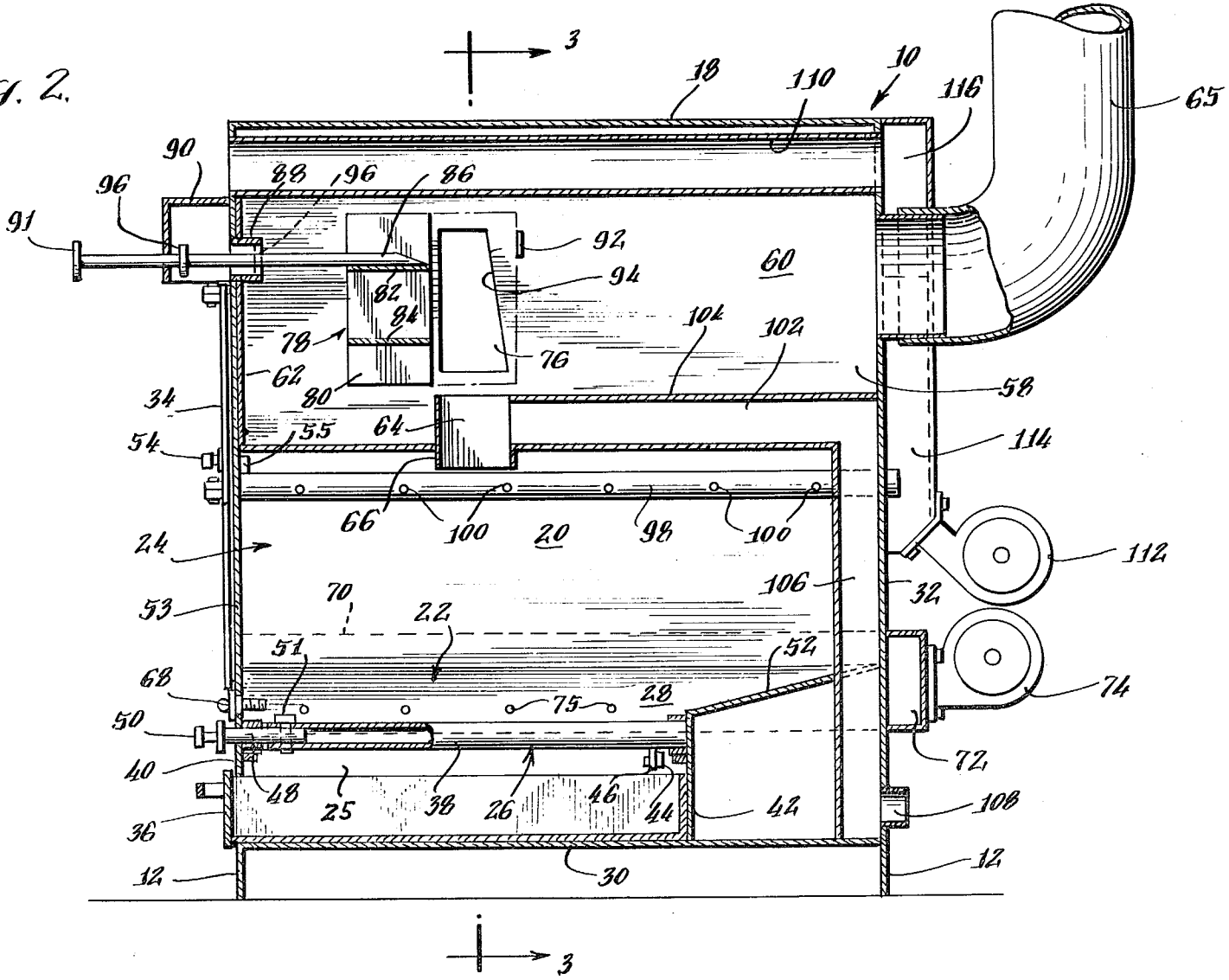
FIG. 2 is a vertical longitudinal section taken on the line 2—2 of FIG. 1.

As shown in FIGS. 1 and 2, one of the pipes 38 is provided with a rod 48, which extends forwardly through an opening in panel 40 and is provided at its outer end with a crank arm 50, by which to manually pivot pipes 38 back and forth in order to shake down the ashes. For convenience in removing grate 26, rod 48 is telescoped within the one pipe 38 and fastened thereto by means of a headed pin 51, which fits freely through holes drilled in both the pipe and rod. By removing pin 51 and withdrawing rod 48 through the front of the burner, grate 26 can be lifted as a unit for removal through either of the doorways 33, 33.

It will be noted that a forwardly sloping pan 52 is provided at the back of the combustion chamber between the top of the intermediate panel 42 and the rear wall 32 of casing 10 for diverting coals and ashes at the back of the burner forward onto grate 26.

A vertical brace 53 is welded top and bottom in the center of the front opening between doorways 33, 33 and acts as a jamb against which doors 34, 34 close for sealing engagement therewith. If desired, asbestos gaskets (not shown) may be provided on doors 34, 34 for sealing the doors when closed. Each door is also provided with a handle 54 having a locking lug 55 on the inside of the door for latching engagement in back of brace 53 when the handle is rotated.

As best shown in FIG. 3, the upper central portion of the combustion chamber within casing 10 is divided into two areas (designated generally at 56 and 57) by an exhaust chamber 58, which is formed by a V-shaped baffle made up of a pair of inwardly sloping partitions 60, 60 that extend the full length of the burner. Each partition 60 is welded along its upper edge to the casing 10 at the juncture of the top plate 18 with one of the sloping upper walls 16, 16, and to each other along their bottom edges directly above the center of grate 26. In addition, the rear edges of partitions 60, 60 are welded to the rear wall 32 of casing 10, the front end of exhaust chamber 58 being closed off by a triangular plate 62 welded to the front edges of partitions 60, 60. Chamber 58 is accordingly separate from the combustion chamber 24.

A relatively small opening 64 is formed in the bottom of exhaust chamber 58 by rectangular cut-outs at the intersecting edges of partitions 60, 60. Combustion products are therefore drawn from the combustion chamber 24 through the opening 64 into the exhaust chamber 58 and then through a stack connection into a chimney or smoke stack 65 at the rear of the exhaust chamber. A rectangular tube 66 extends vertically downward from opening 64 for the purpose of reducing the amount of unburned combustion products escaping from the combustion chamber.

Air for combustion is provided through a conventional adjustable air-damper 68 (FIG. 2) in the front panel 40 above grate 26, or through the ash pit 25 by sliding the ash pan 36 out a short distance in order to allow air to be drawn up through the grate. In this instance, a forced-air draft is also provided by means of rectangular air ducts 70, 70 provided on each side of the primary fire zone 22 of combustion chamber 24. Ducts 70, 70 each extend the length of the burner and open into a manifold 72 at the rear of the burner. A blower 74 is mounted at the center of the manifold 72 for supplying air at a suitable pressure to manifold 72 and ducts 70, 70, from which it flows into the primary fire zone 22 through horizontal rows of openings 75 (FIGS. 2, 3 and 5) in the vertical side panels 28 on both sides of grate 26. The provision of a forced-air draft in this manner has been found desirable in order to maintain a uniform fire under different atmospheric conditions which, due to the extremely high efficiency of the burner, can reduce the amount of air furnished by natural draft below that needed to maintain the fire at a desired level of intensity.

It will be noted that while the size of opening 64 between the combustion chamber 24 and exhaust chamber 58 provides adequate draft for an established fire that has been brought up to normal operating temperature, it is small in comparison with the flue opening to the chimney 65, so that provision for additional draft through the burner must be made, in order to furnish enough air when starting a fire. To this end, a large opening 76 is provided above the exhaust opening 64 in each of partitions 60, 60 that form the sides of exhaust chamber 58, so that when the fire is first lit, the smoke is drawn from the two areas 56 and 57 of the combustion chamber, virtually by-passing the normal exhaust opening 64. However, as the fire increases in intensity and temperature, less draft is required. By-pass openings 76, 76 can then be closed by sliding a V-shaped shutter-valve 78 (FIGS. 2 and 3) into position across both the openings 76, 76.

Shutter-valve 78 is formed of two side plates 80, 80 which fit flush with the inner surfaces of partitions 60, 60 and are joined by horizontal cross-braces 82 and 84 welded thereto. As indicated in broken lines in FIG. 3, valve-plates 80, 80 are large enough to completely cover by-pass openings 76, 76 but do not extend below the upper edges of the opening 64, so that when valve 78 is closed, it does not interfere with the flow of the hot gases through opening 64. In addition, the lower brace 84 of valve 78 should be spaced above the lower edges of valve plates 80, 80, so that it does not block the opening 64 when the by-pass openings 76, 76 are closed.

A horizontal rod 86 is welded to the upper cross-brace 82 and projects forwardly through a short duct 88 (FIG. 2) in the front wall of casing 10 and through a smoke hood 90 above the loading doors 34. A suitable knob 91 is provided on the outer end of rod 86 for sliding shutter-valve 78 longitudinally of the exhaust chamber 58 into and out of closing relationship with by-pass openings 76, 76. A stop lug 92 welded on the inner surface of one of the partitions 60 locates valve 78 in its fully closed position. It will also be noted that the rear edge 94 of each of the by-pass openings 76 slopes rearwardly from top to bottom, so that if necessary the amount of draft through the burner can be adjusted by pulling the valve 78 back slightly from its fully closed position in order to crack the openings 76.

As shown in FIG. 1, smoke hood 90 extends the full width of the burner above doors 34, 34 for trapping any smoke which may escape when the doors are opened for the purpose of adding logs to the fire. Since the pressure inside the exhaust chamber 58 is lower than atmospheric pressure, due to the natural draft from flue 65, any smoke trapped in hood 90 is drawn into the burner through duct 88.

Damper control-rod 86 is provided with a circular disc 96, which slides inside duct 88, closing it when valve 78 is moved to its closed position as indicated in broken lines in FIG. 2. Since the by-pass openings 76, 76 are closed, or only cracked open, during normal operation of the burner, air is drawn through the duct 88 only when control-rod 86 is pulled far enough out to withdraw disc 96 from duct 88. Consequently, as is customary with burners or furnaces having a flue valve, the damper control-rod 86 should be pulled out as far as it will go to open by-pass openings 76 before the doors 34, 34 are opened. Opening by-pass openings 76, 76 greatly increases the natural draft through the combustion chamber when a fire is burning, so that when the doors are opened, no smoke should escape through the doorways. However, if some smoke does escape, it is immediately trapped by hood 90 and drawn through duct 88 into the exhaust chamber 58.

Referring to FIGS. 3 and 5, it will be seen that during normal operation of the burner, the wood directly above grate 26 (i.e. in the area 22) burns with the most intense heat, generating hot combustible gases. As in the case of all solid-fuel burners, the combustion products thus generated can not be completely burned immediately because the provision of enough air for complete combustion would adversely increase the burning rate and produce too much heat in a short period of time. As indicated by the arrows a, most of the hot partially burned combustion products rise from the burning wood and are diverted outwardly into the upper areas 56 and 57 of the combustion chamber 24 by the partitions 60, 60 of exhaust chambers 58. In these upper areas the combustion products rapidly cool, losing much of their heat to the partitions 60, 60. When the combustion products reach the uppermost part of areas 56 and 57, they are deflected downward as indicated by the arrows b, by the sloping outer walls 16, 16, to which they rapidly transfer more heat. The fact that gases b are cooler than the gases a coming off the fire increases the tendency for them to flow down the outer side walls 14, 14 and through the logs toward the fire, thereby establishing a circular path of gases on both sides of the combustion chamber.

In order to provide more air for combustion of the unburned portions of the gases b moving downward under the turbulence thus created, a secondary air-duct 98 is provided inside the casing 10 adjacent the intersection of the lower edge of each of the outer side walls 14, 14 with the bottom walls 20, 20. As shown in FIG. 2, ducts 98, 98 are each provided with a row of holes 100 facing inwardly and downwardly, so that as the cooler gases b flow downward, they mix with additional air drawn through holes 100, and the combustible mixture thus formed flows down into the intense heat of the fire, where it is completely burned. Secondary air-ducts 98 extend the full length of the burner, being closed off at the front adjacent doors 34, 34, but passing through the rear wall 32 where they are open to the atmosphere, or if desired, connected to the forced-draft manifold 72.

The combustion products in the combustion chamber continue to recirculate in the manner hereinabove indicated until most, if not all, the hydrocarbons and other burnable matter are burned by the addition of air through ducts 98, 98. The only gases permitted to escape from the combustion chamber are those (indicated by the arrows c in FIG. 3) which pass through the opening 64 in the bottom of the exhaust chamber 58 at the intersection of the partitions 60, 60. It will be noted that one of the purposes of the tube 66, which extends downward from opening 64, is to prevent unburned combustion products in the upper regions 56 and 57 from escaping the combustion chamber until they have been recirculated sufficiently with air from ducts 98, 98 to burn all the combustibles.

Obviously, however, some of the gases c passing through the exhaust tube 66 contain a small amount of unburned material. Consequently, in order to still further improve the efficiency of the burner, a supplemental air-duct 102 is formed at the apex of the V-shaped exhaust chamber 58 by means of a narrow, horizontal plate 104 extending from the opening 64 rearwardly to the back wall 32, plate 104 being welded along both sides to the partitions 60, 60. A vertical duct 106 extends upward along the inside of wall 32, centrally thereof, from an opening 108 through the rear wall 32 to the atmosphere near the bottom of casing 10. Since the upper end of duct 106 is in open communication with the horizontal duct 102, air can be drawn into the exhaust tube 66 for the purpose of completing combustion of any unburned material in the hot gases c as they enter the exhaust chamber 58.

If desired, the supplemental air furnished to the exhaust tube 66 may be supplied by any other suitable air duct, such as one that enters the tube 66 near its lower end where the combustion products are hottest due to the fact that they are closer to the fire. It will also be apparent that the secondary air-ducts 98, 98 may be located at other points in the upper regions of the combustion chamber where air can be drawn or forced into the combustion chamber to mix with the unburned combustion products. However, care should be taken to prevent such supplemental air-ducts from creating a stack-effect which would result in leakage of smoke through the air-duct into the room. By locating the air-ducts 98, 98 at the outer side walls 14, 14 and by directing the holes 100 downward, the turbulence of the combustion products in the combustion chamber due to the central V-shaped partitions 60, 60 causes the air to be drawn through ducts 98, 98 into the combustion chamber with the combustion products. Furthermore, the natural draft of the flue through the exhaust chamber 58 will reduce the pressure in the combustion chamber 24 below atmospheric pressure, thereby preventing smoke from escaping through ducts 98, 98.

Gases entering the exhaust chamber 58 through the opening 64 rise to the top of the chamber and flow rearward toward the chimney 65. In this instance, warm-air ducts 110 are provided in the upper portion of the exhaust chamber for transferring heat from the exhaust gases, as well as from the partitions 60, 60, to room air circulated through them by means of a blower 112 at the rear of the burner, which pumps air through a vertical duct 114 into a warm-air manifold 116 into which heat-transfer ducts 110 open. It will of course be apparent that circulation of room air through ducts 110 can also be effected by natural convection.

Since substantially all the volatile matter released by the fuel is burned inside the combustion chamber before it enters the exhaust chamber, there is no condensation of the gases or formation of creosote inside the exhaust chamber or in the stack. Moreover, in practice where supplemental air is supplied at the exhaust opening from the combustion chamber, it has been observed that a low blue flame is produced inside the opening, evidencing the fact that the small amount of unburned matter which manages to escape from the combustion chamber is being burned as it enters the exhaust chamber. The heat thus produced is absorbed by the heat-exchanger ducts in the exhaust chamber, and is therefore utilized instead of being lost up the chimney.

What is claimed is:

1. A wood burner comprising a casing forming a combustion chamber having a pair of planar bottom wall means for supporting a load of wood to be burned, said planar bottom wall means being inclined downwardly toward the center of said combustion chamber, means located adjacent the lower edges of said planar bottom wall means for supplying air to said combustion chamber to form a primary fire zone substantially vertically above said air supply, the slope of said planar bottom wall means being gradual enough to provide space within the combustion chamber for said wood outward of said fire zone, while being steep enough to ensure the wood stacked against said bottom walls gravitates into said primary fire zone as the wood in said zone is consumed by the fire, and a substantially V-shaped partition disposed in the upper portion of said combustion chamber centrally thereof with the apex of said V-shaped partition extending downward into close proximity to said primary fire zone, such that unburned combustion products rising therefrom are deflected outwardly by said V-shaped partition into the upper portions of the combustion chamber on opposite sides of said partition and recirculated as they cool downwardly into said primary fire zone, said partition having a restricted exhaust opening adjacent its apex for continuously exhausting combustion products from said combustion chamber.

2. A solid-fuel burner as defined in claim 1, wherein said V-shaped partition defines an exhaust chamber in the upper part of said casing substantially separate from said combustion chamber but communicating therewith by means of said exhaust opening, said casing having an outlet from said exhaust chamber to a chimney.

3. A solid-fuel burner as defined in claim 2, wherein said V-shaped partition is provided with at least one by-pass opening to said combustion chamber for increasing the draft through the burner and having valve-means for closing said by-pass opening.

4. A solid-fuel burner as defined in claim 3, wherein a said by-pass opening is formed in one side of said V-shaped partition above said exhaust opening, and which further includes a second by-pass opening in the opposite side of said partition corresponding to said first by-pass opening, said valve-means being adapted and arranged to open and close said by-pass openings simultaneously, said valve-means comprising a shutter-valve supported by said V-shaped partition within said exhaust chamber.

5. A solid-fuel burner as defined in claim 4, which includes secondary air-supply means mounted on each side of said casing for introducing secondary air into said combustion chamber adjacent the upper portions of said sloping bottom walls, such that said secondary air mixes with said recirculating combustion products to form a combustible mixture before said combustion products re-enter said primary fire zone.

6. A solid-fuel burner as defined in claim 5, which further includes a supplemental air duct extending from a supply of air to said exhaust opening for introducing supplemental air thereto in order to mix with unburned combustion products escaping from said combustion chamber.

7. A solid-fuel burner as defined in claim 4, wherein said shutter-valve comprises a V-shaped member having two side plates each disposed to fit flush with one side of said V-shaped partition for sliding engagement therewith longitudinally of said exhaust chamber into and out of closing relationship with said by-pass openings, and having means for remotely operating said shutter-valve.

8. A solid-fuel burner as defined in claim 6, which further includes a fuel-loading door in an end wall of said casing, a smoke hood over said door for trapping smoke when said door is opened, a smoke duct of predetermined length extending through said end wall for connecting the space under said hood with said exhaust chamber such that smoke trapped by said hood can be drawn into said exhaust chamber, said operating means for said shutter-valve comprising a control rod fixed to said shutter-valve and extending through said smoke duct, and a smoke duct shutoff disc fixed to said control rod, said disc being shaped to fit closely within said smoke-duct and disposed on said control rod such that when said shutter-valve completely exposes said by-pass openings said shutoff disc is withdrawn from said smoke-duct in order to exhaust the smoke under said smoke hood.

9. A solid-fuel burner as defined in any of claims 1 through 4, 6, 7 or 8, which includes secondary air-supply means mounted on said casing for introducing secondary air into said combustion chamber above said primary fire zone such that said secondary air mixes with said recirculating combustion products to form a combustible mixture before said combustion products re-enter said primary fire zone.

10. A solid-fuel burner as defined in any of claims 1, 2 and 3 through 8, wherein said exhaust opening is provided with a tubular member extending downward therefrom toward said primary fire zone for limiting the amount of unburned combustion products which escape from said combustion chamber.

11. A wood burner as defined in claims 3 or 4, which further includes a supplemental air duct extending from a supply of air to said exhaust opening for introducing supplemental air thereto in order to mix with unburned combustion products escaping from said combustion chamber.

* * * * *